US008097313B2

(12) United States Patent
Wallat

(10) Patent No.: US 8,097,313 B2
(45) Date of Patent: Jan. 17, 2012

(54) MULTILAYER BAG OF PAPER

(75) Inventor: Hans-Dieter Wallat, Trebsen (DE)

(73) Assignee: Mondi AG, Vienna (AT)

( * ) Notice: Subject to any disclaimer, the term of this patent is extended or adjusted under 35 U.S.C. 154(b) by 639 days.

(21) Appl. No.: 12/085,352

(22) PCT Filed: Jan. 20, 2007

(86) PCT No.: PCT/EP2007/000484

§ 371 (c)(1),
(2), (4) Date: Jul. 25, 2008

(87) PCT Pub. No.: WO2007/085390

PCT Pub. Date: Aug. 2, 2007

(65) Prior Publication Data

US 2009/0148636 A1 Jun. 11, 2009

(30) Foreign Application Priority Data

Jan. 26, 2006 (EP) ..... 06001597

(51) Int. Cl.
*B29D 22/00* (2006.01)
*B32B 1/04* (2006.01)
*B32B 27/10* (2006.01)

(52) U.S. Cl. ..... 428/34.3; 428/34.2; 220/680; 220/678; 383/107

(58) Field of Classification Search ..... 428/34.3, 428/34.2; 493/189, 933; 220/62.13, 62.22, 220/680, 913
See application file for complete search history.

(56) References Cited

U.S. PATENT DOCUMENTS

| | | | | |
|---|---|---|---|---|
| 3,449,186 | A * | 6/1969 | Rano | 156/159 |
| 3,770,540 | A * | 11/1973 | Fuchs et al. | 156/157 |
| 3,927,825 | A * | 12/1975 | Stearley | 383/114 |
| 4,080,235 | A * | 3/1978 | Mandersson | 156/218 |
| 4,256,526 | A * | 3/1981 | McDaniel | 156/295 |
| 4,270,658 | A * | 6/1981 | Schuster | 206/439 |
| 4,470,153 | A * | 9/1984 | Kenan | 383/101 |
| 4,566,927 | A * | 1/1986 | Wood | 156/203 |
| 4,617,211 | A * | 10/1986 | Fries, Jr. | 428/34.2 |
| 4,726,169 | A * | 2/1988 | Achelpohl et al. | 53/455 |
| 4,755,412 | A * | 7/1988 | Glans et al. | 428/121 |
| 4,911,685 | A * | 3/1990 | Hucks | 493/264 |
| 5,097,956 | A * | 3/1992 | Davis | 206/524.8 |
| 5,470,594 | A * | 11/1995 | Di Mino | 426/87 |
| 5,474,818 | A * | 12/1995 | Ulrich et al. | 428/34.3 |
| 5,493,844 | A * | 2/1996 | Combrink | 53/410 |
| 5,810,243 | A * | 9/1998 | DiPinto et al. | 229/198.2 |
| 5,846,619 | A * | 12/1998 | Cahill et al. | 428/34.2 |
| 6,207,249 | B1 * | 3/2001 | Lencoski et al. | 428/132 |

(Continued)

OTHER PUBLICATIONS

International Preliminary Report on Patentability issued Aug. 7, 2008 in the International (PCT) Application No. PCT/EP2007/000484.
English translation of the International Preliminary Report on Patentability issued Sep. 9, 2008 in connection with PCT/EP2007/000484.

*Primary Examiner* — Michele L Jacobson
(74) *Attorney, Agent, or Firm* — Wenderoth, Lind & Ponack, L.L.P.

(57) ABSTRACT

A multilayer bag includes at least one outer paper layer and at least one inner paper layer and a synthetic layer located between the outer and an inner paper layer. On the longitudinal side of the paper bag, an overlap of the outer paper web and a partial overlap of the synthetic web is provided, and the outer paper web is partially adhered to itself in the region of overlap.

8 Claims, 2 Drawing Sheets

U.S. PATENT DOCUMENTS 6,312,778 B1 * 11/2001 Sandell ..... 428/57
6,815,022 B2 * 11/2004 Renck et al. ..... 428/34.3
6,893,686 B2 * 5/2005 Egan ..... 427/496
7,157,126 B2 * 1/2007 Cosentino et al. ..... 428/34.3
2004/0105600 A1 * 6/2004 Floyd, Jr. ..... 383/109
2007/0047853 A1 * 3/2007 Sharp et al. ..... 383/106

* cited by examiner

MULTILAYER BAG OF PAPER

BACKGROUND OF THE INVENTION

The invention relates to a multilayer bag comprised of paper, which includes on its inside a film layer and has improved protection of the bagged goods against moisture as well as improved venting during the filling.

To attain good moisture protection of moisture-sensitive goods, paper bags frequently comprise synthetic webs as inner layers or between two paper layers. The synthetic web is either provided with apertures or needled or perforated to ensure adequate air permeability or venting during the filling of the bag.

EP 0 867 379 A1 discloses a perforated bag, in which perforation occurs through all layers of the bag. Thereby, adequate air permeability is ensured. However, there is no longer any reliable protection against moisture. Such a bag, furthermore, is no longer suitable for holding bagged goods in powder form.

WO 98/57861 discloses a multilayer paper bag suitable for holding powder-form bagged materials. The paper bag here comprises, at least in the intermediate synthetic layer, perforations in band or strip form on each broad side. To ensure adequate air permeability, these perforations or apertures must have a diameter of appropriate size. However, this reduces the strength of the bag. This is especially disadvantageous when holding goods of high weight.

SUMMARY OF THE INVENTION

The invention therefore addresses the problem of providing a paper bag with improved moisture protection of the bagged goods, and simultaneously having adequate air permeability or venting capability during the filling of the bag.

The subject matter of the invention is therefore a multilayer bag comprised of at least one outer 1 and at least one inner 5 paper layer and, located between an outer and an inner paper layer, a layer of synthetic material 2. The paper bag is provided on its longitudinal side with an overlap 4 of the outer paper layer 1 and a partial overlap of the synthetic layer 2, and the outer paper layer 1 is partially adhered to itself in the region of overlap 4.

The partial adhesion 3 of the externally disposed paper layer 1 takes place on two substantially parallel lines, and the points of adhesion can be located at the same level one next to the other or offset with respect to one another.

In a further embodiment, the partial adhesion 3 can be carried out along a line.

The spacings between the adhesion points or the spacings between the partial adhesion lines are a function of the consistency and weight of the bulk material.

The inner paper layer is continuously connected, for example by adhesion, in its longitudinal region of overlap.

The discrete plies of the bag are advantageously at least partially connected with one another. The synthetic intermediate layer in the finished bag is secured in position by simple overlapping.

As the intermediate synthetic layer 2 can be, for example, synthetic films of polyolefins, such as polypropylene, polyethylene, their copolymers or mixtures.

The thickness of the intermediate synthetic layer 2 is preferably approximately 10 to 100 μm.

In a further embodiment, instead of the synthetic intermediate layer 2, the outer paper layer 1 can include a coating of a synthetic material. In this case, however, a coating-free margin strip must be provided in which the partial adhesion is carried out.

The bag can, moreover, comprise further plies, for example a further synthetic layer as an additional barrier layer. The outer 1 and/or inner layer 5 of paper can, moreover, be implemented such that they are multilayered. The bag according to the invention is in particular suitable for products requiring moisture protection, that are filled into the bag entraining large quantities of air and at high filling speed, for example via a filler nozzle.

Through the discontinuous longitudinal adhesion 3 of the outer paper layer 1, the air can escape completely still during the filling process. Thereby, firmer compacted packing of most powder-form products can be attained. Examples of products filled and bagged in the bag according to the invention are, for example, cement, grout/mortar, auxiliary construction materials, chemical products, foodstuff or animal feed and the like.

The bag can be a block bottom bag, cross bottom bag, side gusseted bag or a pouch.

BRIEF DESCRIPTION OF THE DRAWINGS

FIGS. 1 and 2 show a segment of the embodiments according to the invention of the multilayer paper bag in elevation, particularly the overlap of the outer layer and the discontinuous longitudinal adhesion.

FIG. 3 depicts an embodiment in cross section.

REFERENCE NUMBERS

1: outer paper layer
2: synthetic intermediate layer (or synthetic coating of the outer paper layer)
3: discontinuous longitudinal adhesion of the outer paper layer
4: region of overlap of the outer paper layer
5: inner paper layer with longitudinal adhesion

DETAILED DESCRIPTION OF THE INVENTION

Figure 1:
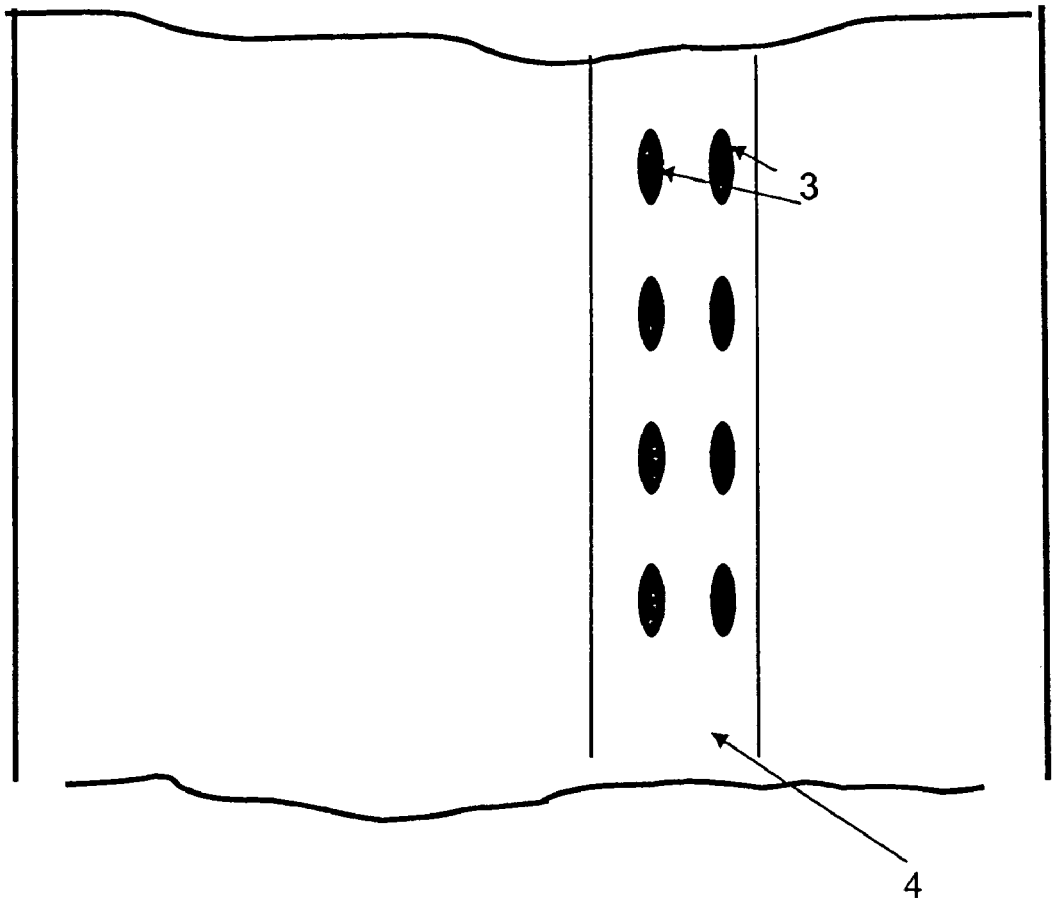
FIGS. 1 to 3 depict embodiments according to the invention of the multilayer paper bag.
Figure 2:
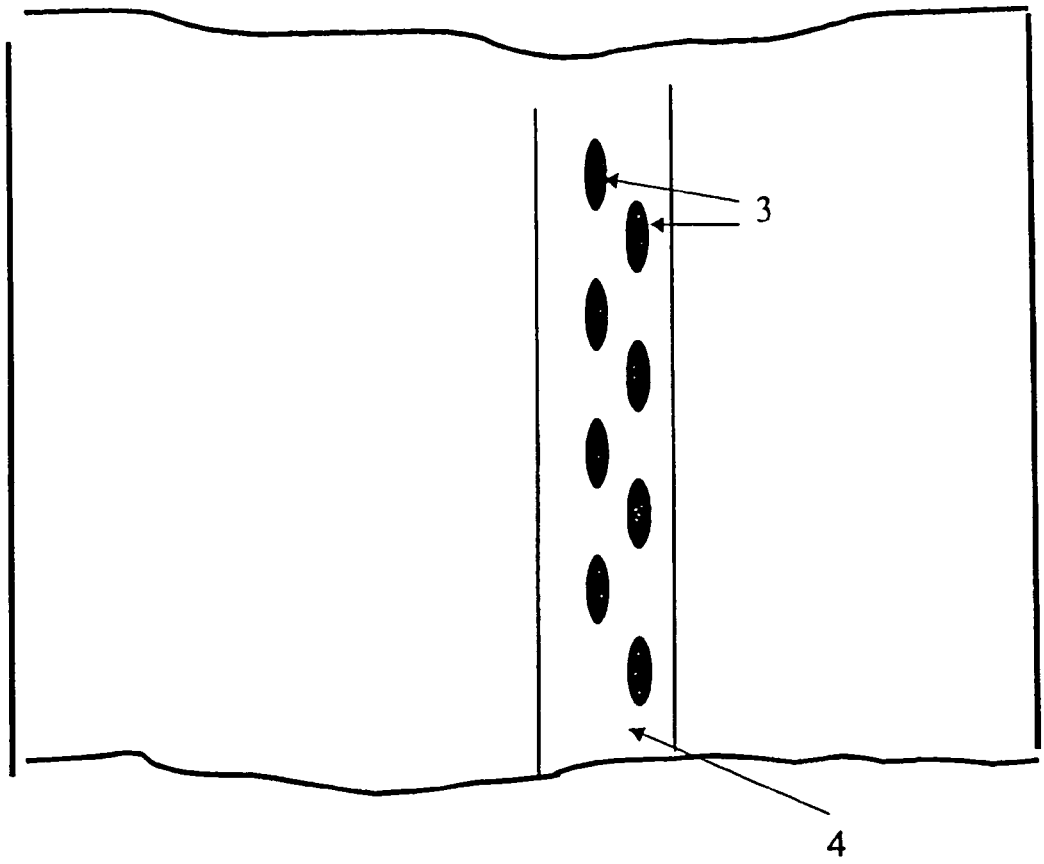
Figure 3:
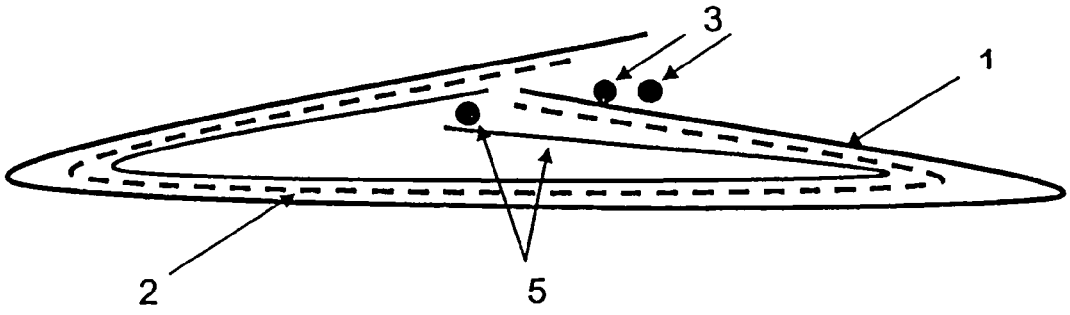

In a first example, a three-layer bag includes an outer paper layer 1 which is 90 g/m$^2$ and a synthetic intermediate layer 2 of PP 20 μm with a simple discontinuous longitudinal adhesion 3. In the region of overlap 4, an edge of the outer paper layer 1 overlaps the opposite edge of the outer paper layer 1 after being folded as shown in FIG. 3. The inner paper layer 5 was comprised of highly porous bag paper (80 g/m$^2$). The bag was filled with 30 kg of adhesive plaster of Paris for facing. During the filling process, an adequate escape of air was observed. During storage, no moisture damage could be detected.

In a second example, a three-layer bag includes an outer paper layer 1 which is 90 g/m$^2$ and a synthetic intermediate layer 2 of PP 20 μm with a double parallel non-offset discontinuous longitudinal adhesion 3. The inside layer 5 was comprised of a highly porous bag paper (80 g/m$^2$). The bag was filled with 30 kg of adhesive plaster of Paris for facing. During the filling process, an adequate escape of air was observed. No damage occurred upon the release of the filler nozzle, and no moisture damage could be detected during storage.

In a third example, a three-layer bag includes an outer paper layer 1 which is 80 g/m$^2$ and a synthetic intermediate layer 2 of PP 15 μm with a double parallel mutually offset longitudinal adhesion 3.

The inner paper layer 5 was comprised of highly porous bag paper (70 g/m$^2$). The bag was filled with 30 kg of adhesive plaster of Paris for facing. During the filling process an adequate escape of air was observed. No damage occurred upon the release of the filler Nozzle, and no moisture damage could be detected during storage.

The invention claimed is:

1. A multilayer bag comprising:

an outer paper layer;

an inner paper layer; and a synthetic intermediate layer located between said outer paper layer and said inner paper layer;

wherein said outer paper layer, said inner paper layer, and said synthetic intermediate layer are configured to form a longitudinal overlap region, said overlap region comprising a first edge of said outer paper layer overlapping an opposite second edge of said outer paper layer, and comprising a first edge of said synthetic intermediate layer overlapping an opposite second edge of said synthetic intermediate layer, said first edge of said outer paper layer being discontinuously adhered to said second edge of said outer paper layer by a plurality of adhesion points in said overlap region.

2. The multilayer bag of claim 1, wherein said adhesion points are formed in at least one line along a longitudinal axis of said overlap region.

3. The multilayer bag of claim 1, wherein said adhesion points are formed in two parallel lines along a longitudinal axis of said overlap region.

4. The multilayer bag of claim 3, wherein said adhesion points of said two parallel lines are aligned adjacent to each other in a non-staggered manner.

5. The multilayer bag of claim 3, wherein said adhesion points of said two parallel lines are arranged in a staggered manner.

6. The multilayer bag of claim 1, wherein said synthetic intermediate layer comprises a synthetic film formed of a polyolefin including at least one of polypropylene, polyethylene, a copolymer of polypropylene and polyethylene, and a mixture of polypropylene and polyethylene.

7. The multilayer bag of claim 1, wherein said synthetic intermediate layer has a thickness in a range of 10 μm to 100 μm.

8. The multilayer bag of claim 1, wherein said synthetic intermediate layer comprises a first synthetic intermediate layer, further comprising a second synthetic intermediate layer adjacent to said first synthetic intermediate layer and forming a barrier layer.

* * * * *